United States Patent [19]

Kimura

[11] Patent Number: 4,831,361

[45] Date of Patent: May 16, 1989

[54] ENVIRONMENTAL ABNORMALITY ALARM APPARATUS

[75] Inventor: Tetsuo Kimura, Tokyo, Japan

[73] Assignee: Nittan Company, Ltd., Japan

[21] Appl. No.: 203,928

[22] Filed: Jun. 8, 1988

[30] Foreign Application Priority Data

Jun. 30, 1987 [JP] Japan ..... 62-161136

[51] Int. Cl.[4] ..... G08B 29/00

[52] U.S. Cl. ..... 340/506; 340/500; 340/510; 340/511; 340/522

[58] Field of Search ..... 340/506, 500, 501, 510, 340/511, 521, 522, 537, 661-663

[56] References Cited

U.S. PATENT DOCUMENTS 4,420,745 12/1983 Dray et al. ..... 340/510
4,470,047 9/1984 Vogt et al. ..... 340/511
4,546,344 10/1985 Guscott et al. ..... 340/511

FOREIGN PATENT DOCUMENTS 59-208692 12/1983 Japan .

*Primary Examiner*—Donnie L. Crosland
*Attorney, Agent, or Firm*—Hill, Van Santen, Steadman & Simpson

[57] ABSTRACT

An environmental abnormality alarm apparatus includes a sensor for detecting a fire, gas leakage, a burglar, or the like in a monitoring area, and a signal processor for receiving an output from the sensor and evaluating the output for an alarm determination reference and generating an alarm. A detecting unit is provided in the monitoring area of the sensor to detect a change in environmental condition resulting from objects or conditions other than those to be detected by the sensor, and an alarm determination reference is changed in accordance with an output state of the detecting unit during signal processing.

2 Claims, 2 Drawing Sheets

ENVIRONMENTAL ABNORMALITY ALARM APPARATUS

BACKGROUND OF THE INVENTION

1. Field of the Invention

The present invention relates to an environmental abnormality alarm apparatus which can change an abnormality determination reference of a sensor for a fire, gas leakage, a burglar, or the like in accordance with environmental conditions of a monitoring area of the sensor, such as the presence/absence of a person or a power consumption amount.

2. Description of the Prior Art

In some conventional abnormality alarm apparatuses which detect a fire or gas leakage and generate an alarm, a determination reference value as an alarming level is changed in accordance with combustibles in a monitoring area or a time zone, i.e., daytime or nighttime, thereby improving reliability.

However, in the above conventional apparatuses, conditions are set such that each sensor is weighted by a predetermined coefficient in accordance with a predetermined statistical tendency, failing to provide flexibility. Therefore, these apparatuses cannot completely cope with a variety of objects to be monitored, such as a state of a building, and hence often generate a false alarm.

SUMMARY OF THE INVENTION

It is, therefore, an object of the present invention to provide an environmental abnormality alarm apparatus which can perform alarm display with high reliability in correspondence to an environmental condition and which rarely generates a false alarm.

The above and other objects are achieved in accordance with the principles of the present invention in an environmental abnormality alarm apparatus having a sensor for detecting a fire, gas leakage, a burglar, or the like, and a signal processor for receiving an output from the sensor and evaluating the output for an alarm determination reference and generating an alarm. The apparatus also has detecting means in monitoring area of the sensor to detect a change in environmental condition caused by objects or conditions other than those which are to be detected by the sensor for the purpose of generating an alarm, and an alarm determination reference is changed in accordance with an output state of the detecting means during signal processing.

DESCRIPTION OF THE PREFERRED EMBODIMENTS

An embodiment of an environmental abnormality alarm apparatus according to the present invention will be described in detail with reference to the accompanying drawings.

Figure 1:
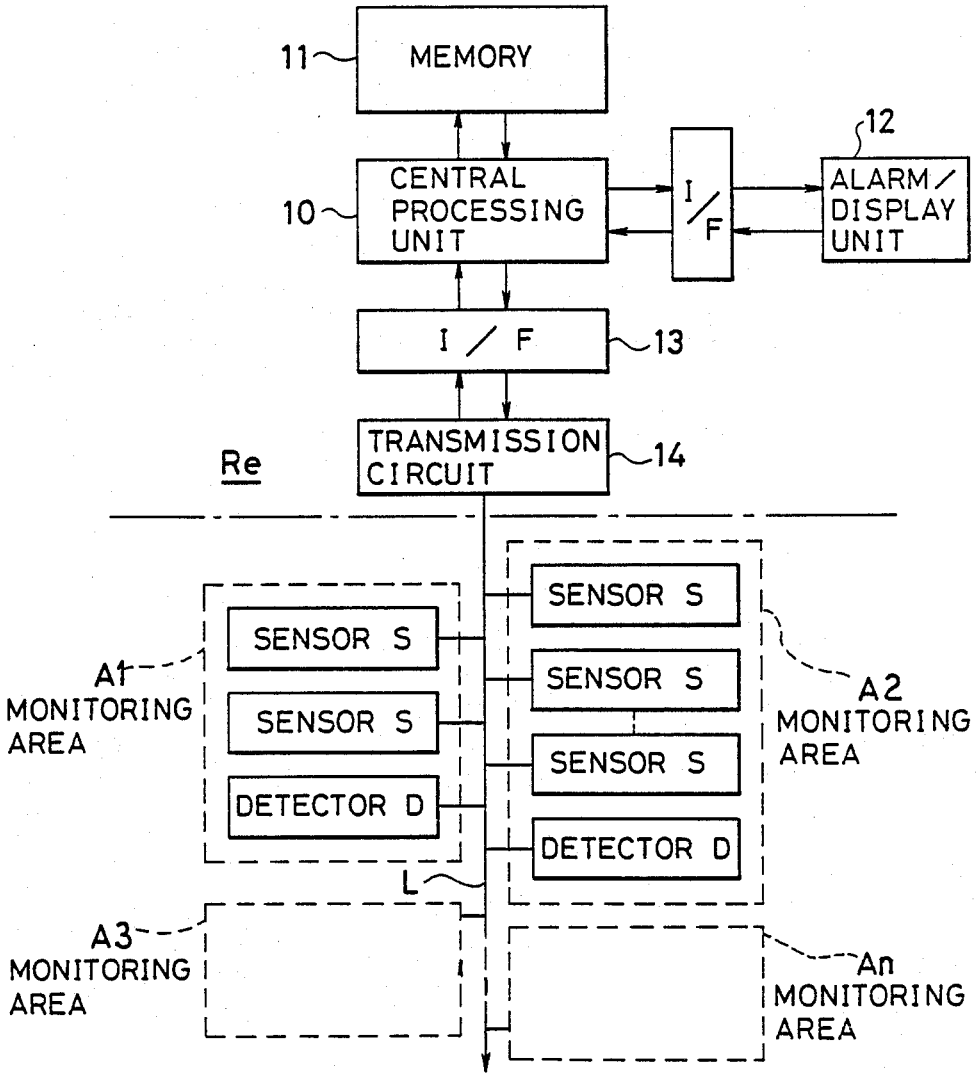
FIG. 1 is a block diagram of a basic arrangement of an environmental abnormality alarm apparatus according to an embodiment of the present invention.
Figure 2:
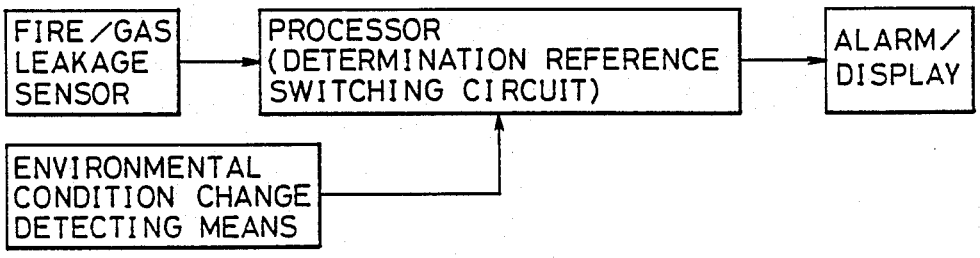
FIG. 2 is a block diagram of main part of the apparatus shown in FIG. 1.
Figure 3:
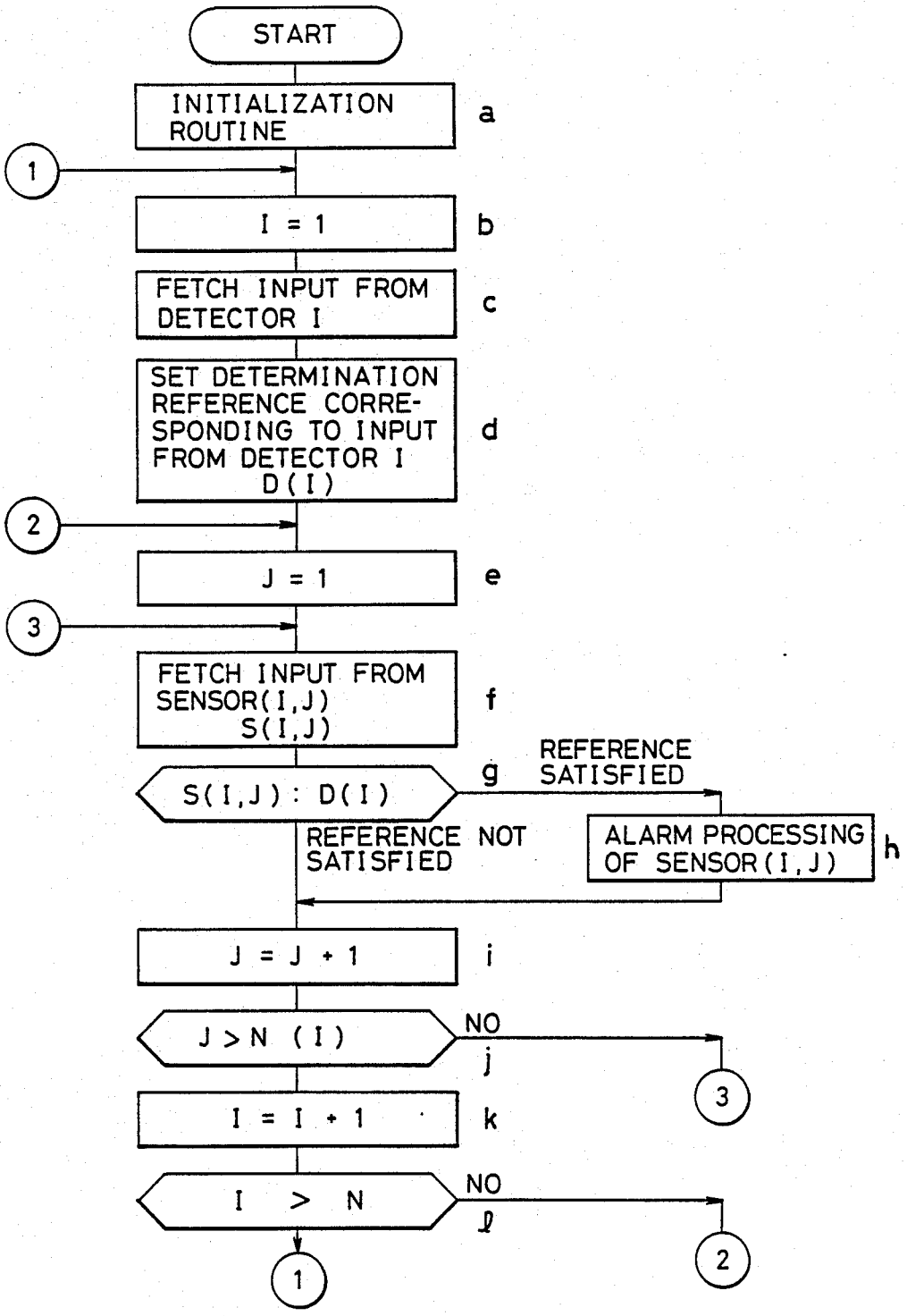
FIG. 3 is a flow chart for explaining the operation of FIG. 1.

FIG. 1 is a block diagram of a circuit arrangement of the present invention, FIG. 2 is a block diagram of main part of the apparatus according to the present invention, and FIG. 3 is a flow chart for explaining the operation of FIG. 1.

In FIG. 1, a common transmission line L leading to monitoring areas A1, A2, . . . An extends from a central monitoring station Re. Each of the monitoring areas Al to An has one sensor S, or a plurality of sensors S, for detecting a dangerous environmental abnormality (such as a fire, a gas leakage, a burglar or the like) and a detector D for detecting an environmental condition of the monitoring area. The detector D detects one or a plurality of artificial environmental change parameters (i.e., parameters which are not sensed by the sensors S for the purpose of generating an alarm) such as the presence/absence of a person, an ON/OFF state of an illumination source, a locked/unlocked state of a lock, a power consumption amount, or a noise amount and selects an optimal parameter based on one or more of these values corresponding to a state of the associated monitoring area.

The central monitoring station Re includes a central processing unit 10 (referred to as a CPU hereinafter) which is connected to the transmission line L through an interface 13 and a transmission circuit 14. The CPU 10 is also connected to a memory 11 for storing abnormality determination references, operation programs, or the like, and to an alarm/display unit 12.

In a normal operation, the central monitoring station Re sequentially and circularly accesses the sensors S and detectors D through the common transmission line L by address polling and fetches environmental information such as a fire, gas leakage, or the presence/absence of a person therefrom by multiplex transmission or the like. These data are processed by the CPU 10 as shown in FIG. 3.

FIG. 3 is an operation processing flow chart for the CPU 10. That is, in steps (b), (c), and (d) of FIG. 3, detection data of the detector D in a predetermined monitoring area are sequentially fetched, and a determination reference corresponding to an output from the detector D is set. For example, in fire alarm equipment, the monitoring areas Al to An correspond to floors of an office building. In this case, if the detector D is adapted to detect the presence/absence of a person, determination reference value is set higher, i.e., sensitivity is set lower, when people are present in a room, and the determination reference value is set lower when no one is in the room.

A detector for detecting an ON/OFF state of an illumination lamp may be provided as the detector D in addition to that for detecting the presence/absence of a person so that the determination reference is set in accordance also with an output from the additional detector.

After the detection data of the detector D are fetched, output data from one of the sensors S in this monitoring area are fetched in steps (e) and (f), and an abnormality is determined in step (g) on the basis of the determination reference value of environmental information for the area. If the output from the sensor S exceeds an abnormality reference value, alarm display of the sensor S is performed in step (h).

If the output from the sensor S is below the abnormality reference value, the flow advances to step (i) and then returns to step (f) to fetch an output from the next sensor S, and the above determination is performed again. This processing is repeated a plurality of times corresponding to the number of the sensors S installed in this monitoring area. After this processing is completed, in steps (k) and (l), the next monitoring area is subjected to the same processing.

As has been described above, according to the environmental abnormality alarm apparatus of the present invention, an environmental condition is detected in units of monitoring areas, and an abnormality determination reference value is changed in accordance with the environmental condition. Therefore, alarm display can be accurately performed in accordance with the environmental condition with high reliability, and a false alarm is rarely generated.

The present invention is not limited to the environmental abnormality alarm apparatus described above. For example, the present invention can be similarly applied to an apparatus in which a sensor for detecting a fire, gas leakage, a burglar, or the like is provided and detecting means for detecting a change in environmental condition other than objects to be detected by the sensor is incorporated in the sensor itself, thereby changing alarm determination processing of the sensor in accordance with a detection result of the detecting means.

Although modifications and changes may be suggested by those skilled in the art it is the intention of the inventor to embody within the patent warranted hereon all changes and modifications as reasonably and properly come within the scope of his contribution to the art.

I claim as my Invention:

1. An environmental abnormality alarm apparatus comprising:

sensor means for detecting a dangerous abnormality in a monitoring area;

signal processor means for receiving an output from said sensor and evaluating said output against an alarm determination reference and generating an alarm based on the evaluation;

detecting means in said monitoring area of said sensor means for detecting an object or condition in said monitoring area other than said dangerous abnormality to be detected by said sensor means; and means for changing said alarm determination reference in accordance with an output of said means for detecting during processing of said output of said sensor means.

2. A method for operating an environmental abnormality alarm apparatus comprising the steps of:

detecting a dangerous abnormality in a monitoring area using at least one sensor, said sensor having an output;

evaluating said sensor output against an alarm determination reference;

generating an alarm signal based on the result of the evaluation;

detecting an object or condition in said monitoring area other than said dangerous abnormality to be detected by said sensor, and generating a signal corresponding to said object or condition; and changing said alarm determination reference in accordance with said signal corresponding to said object or condition during processing of said output of said sensor.

* * * * *